US009191754B2

(12) United States Patent
Barthel et al.

(10) Patent No.: US 9,191,754 B2
(45) Date of Patent: Nov. 17, 2015

(54) METHOD FOR AUTOMATICALLY SETTING A PIECE OF EQUIPMENT AND CLASSIFIER

(71) Applicant: SIVANTOS PTE. LTD., Singapore (SG)

(72) Inventors: Roland Barthel, Forchheim (DE); Clemens Otte, Munich (DE); Florian Steinke, Munich (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/225,711

(22) Filed: Mar. 26, 2014

(65) Prior Publication Data

US 2014/0294212 A1 Oct. 2, 2014

(30) Foreign Application Priority Data

Mar. 26, 2013 (DE) ..... 10 2013 205 357

(51) Int. Cl.
*H04R 25/00* (2006.01)

(52) U.S. Cl.
CPC ..... *H04R 25/50* (2013.01); *H04R 25/505* (2013.01); *H04R 25/70* (2013.01); *H04R 2225/41* (2013.01)

(58) Field of Classification Search
CPC ..... H04R 25/50; H04R 25/70; H04R 25/505; H04R 225/41
See application file for complete search history.

(56) References Cited

U.S. PATENT DOCUMENTS

| | | | | |
|---|---|---|---|---|
| 5,729,658 | A * | 3/1998 | Hou et al. | 704/270 |
| 8,335,332 | B2 | 12/2012 | Aboulnasr et al. | |
| 8,477,972 | B2 | 7/2013 | Buhmann et al. | |
| 2009/0024050 | A1 * | 1/2009 | Jung et al. | 600/544 |
| 2011/0103613 | A1 * | 5/2011 | Van Der Werf et al. | 381/93 |
| 2011/0123056 | A1 | 5/2011 | Aboulnasr et al. | |

FOREIGN PATENT DOCUMENTS

| | | | |
|---|---|---|---|
| WO | 2008084116 | A2 | 7/2008 |
| WO | 2008155427 | A2 | 12/2008 |

OTHER PUBLICATIONS

Ling, T., et al., "Semi-supervised online learning for accoustic data mining", Diss. Eth No. 19395, Eth Zürich, 2010 (http://e-collection.library.ethz.ch/eserv/eth:2801/eth-2801-01.pdf).
Lamarche, L., et al., "Adaptive environment classification system for hearing aids", The Journal of the Acoustical Society of America, 127, pp. 3124-3135, 2010.

* cited by examiner

*Primary Examiner* — Tuan D Nguyen
(74) *Attorney, Agent, or Firm* — Laurence A. Greenberg; Werner H. Stemer; Ralph E. Locher

(57) ABSTRACT

A classification and, in particular, a time stability thereof are intended to be improved. To this end, a method automatically sets a piece of equipment, in which a classifying is performed with an aid of movable clusters and fixed clusters. This allows the classification to be trained, but also allows a certain basic property of the system to be ensured. This is advantageous in particular for hearing aids and transformers in smart grids.

10 Claims, 6 Drawing Sheets

METHOD FOR AUTOMATICALLY SETTING A PIECE OF EQUIPMENT AND CLASSIFIER

CROSS-REFERENCE TO RELATED APPLICATION

This application claims the priority, under 35 U.S.C. §119, of German application DE10 2013 205 357.6, filed Mar. 26, 2013; the prior application is herewith incorporated by reference in its entirety

BACKGROUND OF THE INVENTION

Field of the Invention

The present invention relates to a method for automatically setting a piece of equipment. Moreover, the present invention relates to a classifier for a piece of equipment that can be set automatically. By way of example, the equipment is a transformer to be regulated, an industrial installation to be regulated or a hearing device. Here, a hearing device is understood to mean any equipment creating a sound stimulus, such as a hearing aid, a headset, headphones or the like, which can be worn in or on the ear.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electro acoustic transducer, e.g. a miniaturized loudspeaker, or as an electromechanical transducer, e.g. a bone conduction receiver. The amplifier is usually integrated into a signal-processing unit. This basic design is illustrated in FIG. 1 using the example of a behind-the-ear hearing aid. One or more microphones 2 for recording the sound from the surroundings are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery 5, likewise integrated into the hearing-aid housing 1, supplies the hearing aid and, in particular, the signal-processing unit 3 with energy.

Hearing aids are able to carry out certain equipment settings independently in accordance with the respective hearing situation. Such an equipment setting can be e.g. the activation of noise suppression or a directional microphone. Here, the current hearing situation is described by an input vector (input feature vector). This input vector is imaged on parameters which describe the corresponding equipment setting (also referred to as setting variable below). The imaging prescription which images the input vectors onto parameters is set initially by the manufacturer, with these usually being trained by machine learning methods using a database with known hearing situations. During the subsequent operation, adaptations can be performed on the basis of user inputs. User inputs can include changing a specific setting (e.g. "louder") or the assigning of a specific class (e.g. "this is music"), and can also be performed indirectly by virtue of modifying the respective setting merely being signaled. Here, the following problems are now discussed.

Problem 1: The hearing situations at the respective user can be different to those used for the training at the manufacturer. Specifically, this means that the input vectors in the feature space have a different distribution than what was assumed by the manufacturer. One reason for this can be the occurrence of a completely new hearing situation. Another reason for this could lie in the fact that the user is often in specific situations (e.g. mixed situation "voice with background music and noise") which have little representation in the database, and so the corresponding transitions in the feature space are only modeled relatively approximately. In principle, the problem could be reduced by better databases, but these only exist to a limited extent and, as a matter of principle, it will never be possible for all possible hearing situations to be stored therein.

Problem 2: The deviations between the input vectors at the user and those at the manufacturer can lead to an undesirable behavior of the hearing aid. In particular, the output parameter value can be unstable in time in mixed situations, for example jump between very different values a number of times, which is perceived as very bothersome by the user.

Problem 3: Conventionally, the hearing aid only changes its behavior during subsequent operation as a result of user inputs. That is to say, without an intervention by the user, an unstable behavior in mixed situations remains, even if it is in fact undesirable.

Problem 4: Erroneous (e.g. inconsistent/meaningless) user inputs or the non-occurrence of a specific situation over a relatively long period of time must not cause a substantial deterioration of the system behavior for specific situations. That is to say, the necessary adaptivity of the hearing aid must be balanced against the maintenance of a specific basic behavior, e.g. good understanding of speech in quiet.

There are certain known solution approaches for the aforementioned problems. For example, the article by Lamarche et al., titled: "Adaptive Environment Classification System for Hearing Aids", J. Acoust. Soz. and Am. 127 (5), May 2010, pages 3125 to 3135 describes an adaptive classifier which allows existing classes to be subdivided and/or merged, depending on the distribution of the input vectors. Although, in principle, this allows problem 1 to be solved, it does entail the following disadvantages: (a) setting appropriate criteria for when subdividing/merging should be carried out is difficult; and (b) for a newly split sub-class, statistical variables such as mean value vector and optional covariance matrix can be estimated; this is imprecise, unless many input vectors already belong to the sub-class.

Problems 2 and 3 cannot be solved well therewith because a split-off class initially inherits the parameter values of the class from which it emerges. Regions of the input space, which present mixed situations, can contain neighboring subclasses with possibly strongly varying parameter values, which may lead to an unstable output profile. This approach does not address problem 4.

International patent disclosure WO 2008/084116 A2 ("Method for Operating a Hearing Device") considers an adaptive combination of a plurality of individual classifiers. In a new hearing situation not treated correctly by the existing classifiers (identifiable by a user input in this situation), a new classifier is added for the new situation. The method employs semi-supervised learning in order to determine the weighting function for combining the individual classifiers. A disadvantage here lies in a high complexity (computational outlay) of the method. The basis for the aforementioned patent application is the dissertation by Tser Ling Yvonne Moh, titled "Semi-Supervised Online Learning for Acoustic Data Mining", Diss. ETH No. 19395, ETH Zurich, 2010 (http://e-collection.library.ethz.ch/eserv/eth:2801/eth-2801-01.pdf). Classification problems are considered in the aforementioned work. The use as regression function, i.e. as direct imaging of input vectors on parameter values, is not contained therein. Clustering of the input vectors is not carried out; instead, the input vectors of a time window to be defined are considered.

SUMMARY OF THE INVENTION

The object of the present invention consists of providing a method for automatically setting a piece of equipment, by which an improved setting can be obtained when input signals are situated in an unexpected region of the input space.

According to the invention, the object is achieved by a method for automatically setting a piece of equipment by determining or establishing a feature vector from an input signal of the equipment. At least one movable cluster and at least one fixed cluster is provided in a multidimensional space, wherein the fixed cluster is situated at a fixed first cluster position in the multidimensional space. The movable cluster is displaced in the direction of the feature vector to a second cluster position. Respectively one setting variable is assigned, by means of which the equipment can be set, to the movable cluster and the fixed cluster. The equipment is set on the basis of the first cluster position, the second cluster position and the setting variables.

Moreover, provision is made, according to the invention, for a classifier for an automatically settable piece of equipment. The classifier contains a signal input apparatus for providing an electrical input signal, a feature extraction apparatus for establishing a feature vector from the input signal, and a position assignment apparatus, in which a movable and a fixed cluster are provided in a multidimensional space. The fixed cluster is situated at a fixed first cluster position in the multidimensional space. An adaptation apparatus is provided for displacing the movable cluster in the direction of the feature vector to a second cluster position. Respectively one setting variable, by which the equipment can be set, is assigned to the movable cluster and the fixed cluster. An output apparatus is provided for outputting an output variable for setting the equipment on the basis of the first cluster position, the second cluster position and the setting variables.

Advantageously, at least one movable cluster and at least one fixed cluster are used for the automatic setting of the equipment. Assigned to each of the clusters is a setting variable (also referred to as "label" in the present document), which can contain one or more values by which the equipment can be set. Moreover, the clusters each have a cluster position. The position of the movable cluster is displaced on the basis of the feature vector of the input signal, while the position of the fixed cluster remains unchanged. The displacement of the movable clusters is referred to as input adaptation in the following text. The effect of this input adaptation consists of the fact that the setting of the equipment can also be modified softly if the input signal lies outside of the signal classes as originally predetermined.

The movable cluster is preferably displaced depending on a trigger signal that differs from the input signal. Hence, it is not necessary for the movable cluster to be displaced with each input signal. Rather, the displacement can be started differently in a targeted manner.

By way of example, the trigger signal can be a switch-on signal, a time signal or a user input signal. Therefore, it may be expedient in certain circumstances to undertake a displacement of the clusters only at the start of operation of the respective equipment. Alternatively, it may be advantageous to control the displacement of the clusters in time by a time signal, and thus, for example, bring about an adaptation periodically. A further alternative consists of the adaptation or the displacement of the movable clusters to be brought about by a user input signal, i.e. following a manual input.

In one embodiment of the method according to the invention, there are a multiplicity of movable clusters and the feature vector is assigned to that one of the movable clusters to which it has the smallest spatial distance, and this cluster is then displaced. An advantage of this is that very specifically one or a few clusters can be displaced in the input space in a targeted manner. Moreover, one or more setting variables (label) can be at least in part modified by a user input. An advantage of this is that the relevant equipment can be adapted very individually to the respective user.

Expediently each of the setting variables of the fixed and/or movable clusters can only be modified within a range specifically predefined in each case. This can ensure that a basic characteristic of the equipment to be set is maintained.

The respective setting variable of the displaced cluster or of the clusters is advantageously established by a neighborhood-based regression or recursive updating. As a result of this, there is reduced computational outlay compared to the principle of semi-supervised learning.

The setting variable (label) can be a parameter value, a parameter vector or a predefined or gradual class value. Thus, the setting variable can therefore embody a one-dimensional or multi-dimensional value, or else an intermediate value (class value) for establishing parameter values or parameter vectors.

In a preferred exemplary embodiment, a hearing device and, in particular, a hearing aid is equipped with the aforementioned classifier, wherein the input signal is an audio signal. Using this, the hearing device can also undertake a soft modification of its setting if the input signal cannot be directly assigned to one of the predetermined clusters (classes).

The classifier according to the invention or the method according to the invention can in general also be used for industrial installations, in which action selection rules are required for the operation. The movable clusters in this case also ensure an input adaptation, while the fixed clusters ensure that a basic property of the system is maintained. Then, the user can input corrections into the system by user inputs. In an industrial application, the term "user input" can also be abstracted to mean an external measurement or error signal. On the basis of this external signal, the label values of the clusters are modified in such a way that the settings of the underlying equipment correspond more closely to the desired behavior.

By way of example, a specific example for an industrial installation to be regulated is a transformer, which transforms a medium voltage to a low voltage. Here, on the one hand, there is a demand that the output voltage remains constant and, on the other hand, that the setting is not modified too frequently. The settings of the system can be updated by the input signals, wherein the fixed clusters once again ensure that a basic property of the system remains ensured. Here, the input from a main control room, which only intervenes if there is too big a deviation from an intended prescription, can be interpreted as user interaction.

In particular, the method according to the invention and the classifier according to the invention could also be used for coupling of industrial processes.

The aforementioned method features can also be transferred to the aforementioned classifier, as a result of which corresponding functions of the respective apparatuses of the classifier emerge.

Other features which are considered as characteristic for the invention are set forth in the appended claims.

Although the invention is illustrated and described herein as embodied in a method for automatically setting a piece of equipment and a classifier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The following exemplary embodiments described in more detail constitute preferred embodiments of the present invention.

The examples can relate, in particular, to hearing devices and, specifically, to hearing aids of the type mentioned at the outset. Accordingly, the methods described below can be carried out in a hearing device or in a hearing aid. The classifier according to the invention can likewise be employed in a hearing device which has the further components mentioned at the outset. The examples can also be transferred to transformers, e.g. for so-called "smart grids", or other industrial installations to be controlled or to be regulated.

Figure 1:
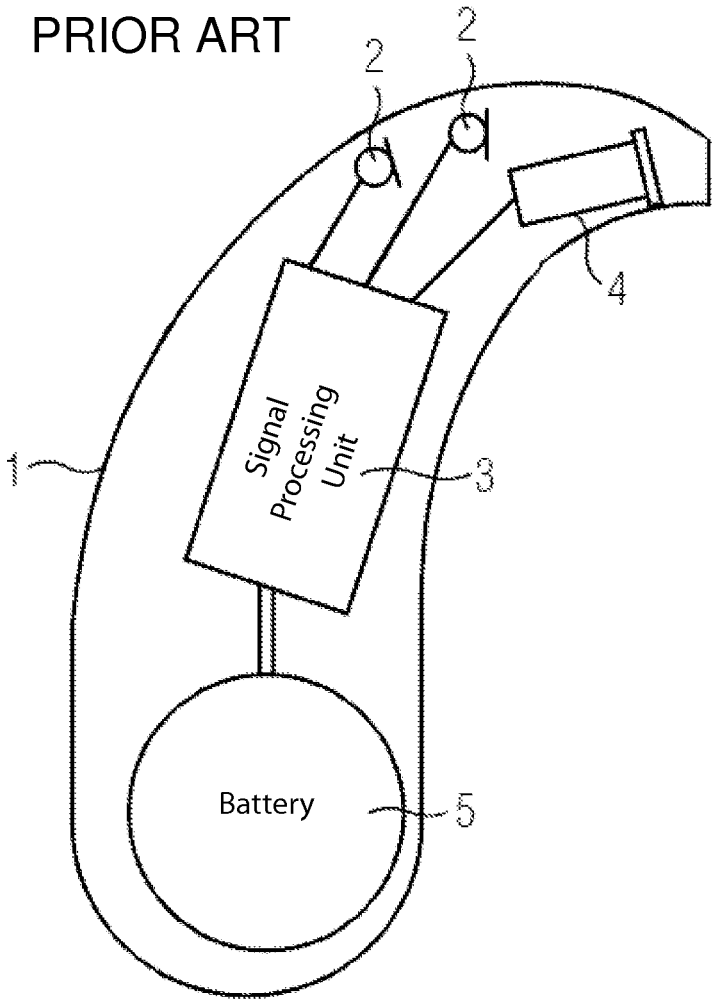
FIG 1 PRIOR ART
FIG. 1 is an illustration of a hearing aid in accordance with the prior art.
Figure 2:
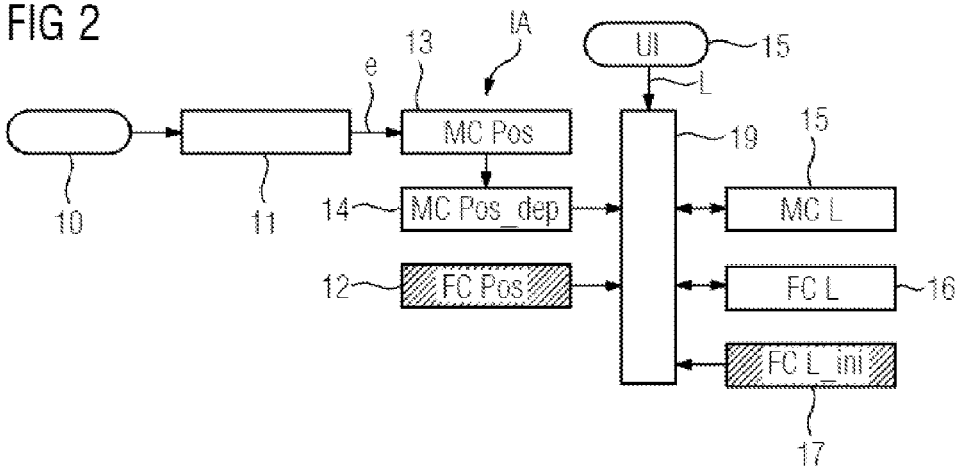
FIG. 2 is a signal flowchart for describing online training according to the invention.

Referring now to the figures of the drawings in detail and first, particularly to FIG. 2 thereof, there is shown an audio input signal 10 that is provided during online training, for example after the microphone in a hearing aid or in a classifier of a signal input apparatus. In a different piece of equipment, this is a correspondingly different input signal. The input signal 10 is fed to a feature extraction apparatus 11. There, possible features, such as e.g. "speech in noise", "speech in quiet", "noise", "music" or "car noise" for a hearing aid, are obtained from the input signal 10 and a corresponding input feature vector e is formed. The set of all input feature vectors forms the input space. Each input feature vector can be assigned to a class or a cluster.

Clusters (which are preferably defined by their mean value vectors, optionally also covariance matrices) are positioned in the input space (e.g. by a position assignment apparatus). A subset of the clusters is fixedly positioned; the subset is referred to here as a factory cluster (FC) and represents the settings by the manufacturer. The positions of the fixedly positioned clusters FC in the multidimensional space are referred to by FC Pos 12. A different subset of the clusters is movable; the subset is referred to here as MC (movable cluster) and follows the dynamic hearing situations of the respective user in the input space. The corresponding position of the MCs is referred to here by MC Pos 13.

The movable clusters MC can be displaced by an adaptation apparatus with each input feature vector e in the space. Updating the movable clusters MC in the input space is referred to as an input adaptation IA in the following. One, several or all movable clusters are affected by the updating. During the online training, it is generally not necessary for the positions MC Pos of one, several or all movable clusters to be updated continuously. Rather, it is sufficient to use current positions of the movable clusters MC depending on a predefined event. By way of example, a trigger signal can thus be used to write the current positions MC Pos 13 to a special memory of the equipment and use the positions for the further online training. These actually used cluster positions are referred to here by MC Pos_dep 14. By way of example, the switch-on signal, a time signal or a user input signal can be used as a trigger signal.

Thus, there is continuous adaptation of the position in the input space for one or more movable clusters during the input adaptation, while the fixed clusters are not adapted. Therefore there is no need for criteria for splitting and merging clusters.

The aforementioned problems 1 and 2 are solved thereby to the extent that the movable clusters are increasingly provided in the regions of the input space which are often or currently addressed in the case of the respective user. Thus, it is possible e.g. to represent transition zones between classes more finely and/or to achieve a smooth temporal output behavior (see FIG. 6). Moreover, problem 3 can be solved provided that the labels of the movable clusters MC are periodically recalculated even without user inputs, e.g. at the system start.

Each cluster has an input variable or a label which describes the values of one or more parameters for setting the equipment (e.g. hearing aid or transformer). By way of example, a label denotes a setting for the volume in several setting steps. However, it can also denote a continuous variable for the setting, i.e. in the output space. By way of example, this would render it possible to describe a gradual (e.g. probabilistic) class membership using a label. A modifiable label of a movable cluster is referred to here as MC L 15. A likewise modifiable label of a fixed cluster FC is represented here as FC L 16. Moreover, the system contains non-modifiable labels FC L_ini 17, which are fixedly predefined by the manufacturer. Naturally, the use of fixed and modifiable labels can be adapted to the respective situation. Thus, it is also possible during an online training for only fixed or only modifiable labels to be used for fixed clusters.

The labels for displaced clusters have to be recalculated. Various processes are suitable for this. What is common to all processes is that clusters neighboring the input space of the user input receive similar labels to the user input. Possible processes for calculating the cluster labels include:

a) Semi-supervised learning, as is used e.g. in international patent disclosure WO2008/084116 A2.

b) Neighborhood-based regression: The label of a cluster displaced during the input adaptation is established with the aid of the labels of the neighboring clusters. If L here is a set of clusters with a known label, L contains the fixed clusters FC, preoccupied by the manufacturer, and a number of stored user inputs 18 (UI). If, moreover, M is the set of all clusters L is a subset of M. A suitable metric is used for each cluster of M to calculate the local neighbors in L, the labels of which are then established and assigned to the cluster as a new label.

The local neighbors can be all neighbors with a distance within a fixed radius or else the k-closest neighbors (k may be fixed or else variable).

In place of a weighted mean, a weighted median can alternatively be used.

By way of example, the distance of the clusters in a neighborhood graph can be used as a metric. The graph connects similar clusters, and so the metric reflects the distances of the clusters in a so-called manifold of the input space. The graph itself can be established by semi-supervised learning.

The main difference from semi-supervised learning is that the neighborhood-based regression is easier to calculate than the semi-supervised learning (the latter requires, inter alia, a matrix inversion).

Figure 7:
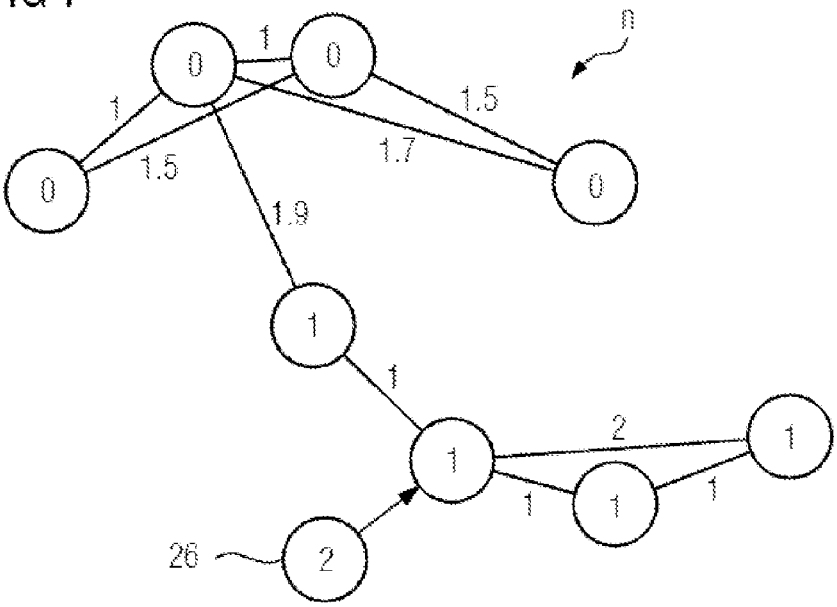
FIG. 7 is an illustration showing an initial situation of cluster labels with a user interaction.
Figure 8:
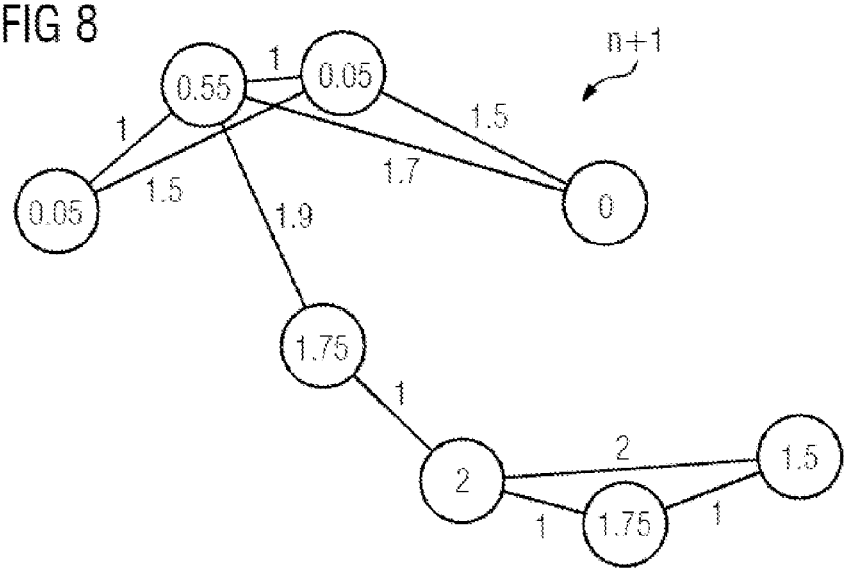
FIG. 8 is an illustration showing the cluster labels which have been adapted due to the user interaction.

Recursive Updating of the Cluster Labels:

The clusters neighboring the user input are established and the labels thereof are each updated recursively, y_new=f (y_old, d, u), where y_new is the new label, y_old is the old label, d is the distance between the user input and the cluster in a suitable metric, u is the label of the user input and f is a suitable function, in which the influence of u on y_new reduces with increasing distance d (see FIGS. 7 and 8).

In addition to the label, each cluster preferably has a specification how far the current label value may change from an initial predefined value. Thus, it is possible to predefine a cluster-specific limitation of the label modification. This can ensure that a specific basic functionality of the hearing aid, in particular a specific system behavior in specific hearing situations is always present, whereas the user is provided with more modification options for other hearing situations (e.g. overlapping regions in the input space in the case of music and speech in noise). The boundaries of the allowed modification can be cluster specific, but this is not mandatory. By way of example, a fixed cluster FC, which contains feature vectors of the class "speech in quiet", can have very restrictive boundaries while stronger modifications by user inputs are allowed for a fixed cluster FC of the class "music" or for a mixed situation.

By way of example, the boundaries can be set automatically during the training at the manufacturer on the basis of the class purity of the respective cluster. By way of example, this can be performed in such a way that well-separated clusters, the input vectors of which are only assigned to a single class, receive tighter boundaries than clusters which contain input vectors of several classes, i.e. which lie in an edge region, and the labels of which therefore are more likely to be modifiable by the user. This can achieve protection against inconsistent user inputs in view of problem 4.

The label MC L 15 of the movable clusters and the label FC L 16 of the fixed clusters are calculated together at specific times with the aid of a computer unit 19. In the process, use may optionally also be made of fixed labels FC L_ini and the variable cluster positions MC Pos_dep and the fixed cluster positions FC Pos in addition to the original labels MC L and FC L. Moreover, it is naturally also possible to take into account label values L from user inputs 18 for establishing the new labels. The respective time for calculating the labels can be brought about by a user input, periodically, or e.g. during the system start.

Thus, during the input adaptation, a movable cluster is adapted to an input vector. To this end, e.g. the closest movable cluster is determined. The movable cluster is displaced a little in the direction of the input vector. Here, the increment can e.g. be 1% or one part in a thousand of the distance between the movable cluster and the input vector for a sampling rate of 10 Hz.

Figure 3:
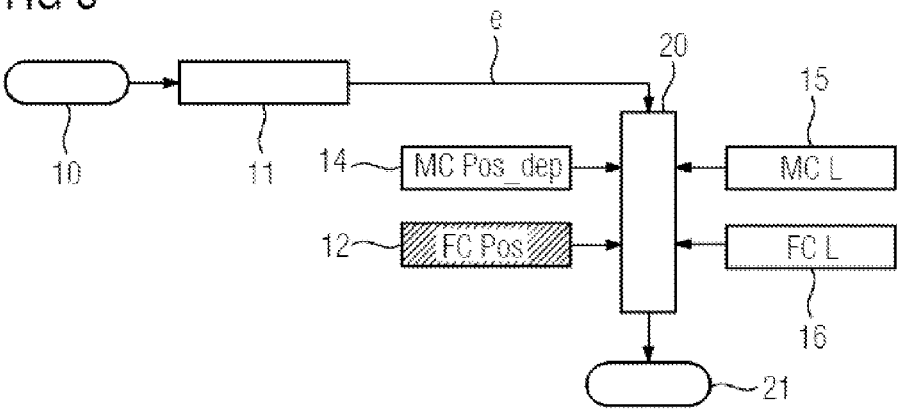
FIG. 3 is a signal flowchart for describing an operation of a piece of equipment after the training.

After the online training in accordance with FIG. 2, the learned clusters and labels can be used during the operation of the equipment. Here, the feature extraction unit 11 once again obtains an input feature vector e from the input signal 10, as is depicted in FIG. 3. An output variable 21, in particular a parameter vector, is calculated with the aid of e.g. a k-closest neighbor algorithm 20 from the cluster positions MC Pos_dep 14 and FC Pos 12 and the labels MC L 15 and FC L 16 and possibly also FC L_ini 17. The parameter vector serves for automatically setting the equipment. As a result of the clusters modified during the input adaptation, it is advantageously possible to achieve, in particular, softer transitions in boundary situations, in which the input signal could not unambiguously be assigned to the original clusters. Using this, neighboring input values are more likely to be able to be assigned to neighboring output values.

Figure 4:
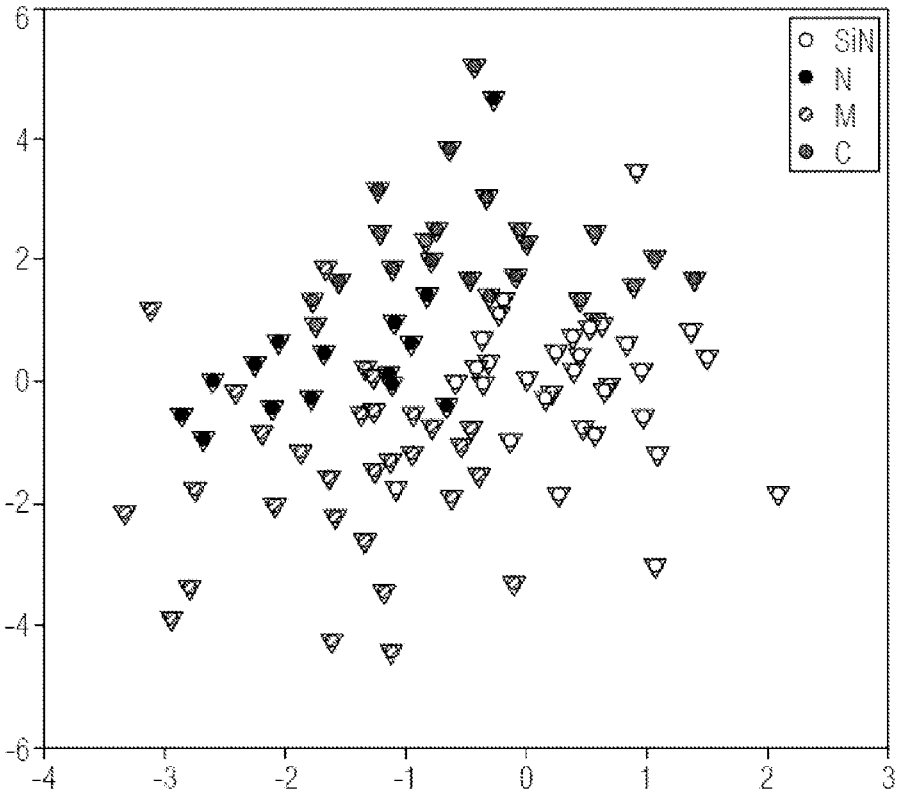
FIG. 4 is a two-dimensional projection of clusters in an input feature space prior to an input adaptation.
Figure 5:
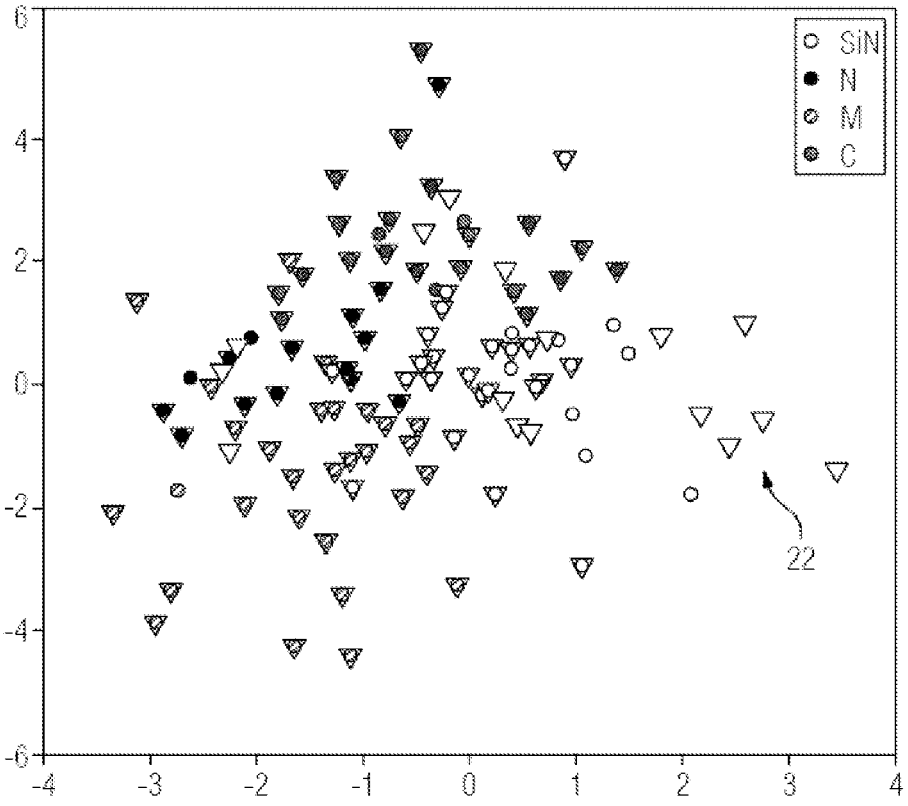
FIG. 5 is a two-dimensional projection of the clusters in the input feature space after an input adaptation.

FIGS. 4 and 5 show a specific example for an input adaptation. FIG. 4 shows a two-dimensional projection of clusters in the input feature space prior to an adaptation. Movable clusters are depicted as triangles, while fixedly predefined clusters are depicted as dots. In particular, clusters of the class "speech in noise" SiN, the class "noise" N, the class "music" M and the class "car noise" C are plotted using different symbols. The fixed clusters and the movable clusters coincide prior to the adaptation. In this case, the hearing aid was trained without the class "speech in quiet" SiQ. Thus, the hearing aid trained in this way cannot uniquely classify audio signals of the class "speech in quiet" prior to the training.

For training purposes, the hearing aid is presented with e.g. a random mixture of 90 minutes of speech in quiet and 45 minutes of sound examples of other classes. As a result of the training, some of the movable clusters (triangles) move to a new region 22, which can be referred to as an SiQ region. Therefore, the hearing aid can, in future, also classify sound examples of the class speech in quiet in an improved manner.

Figure 6:
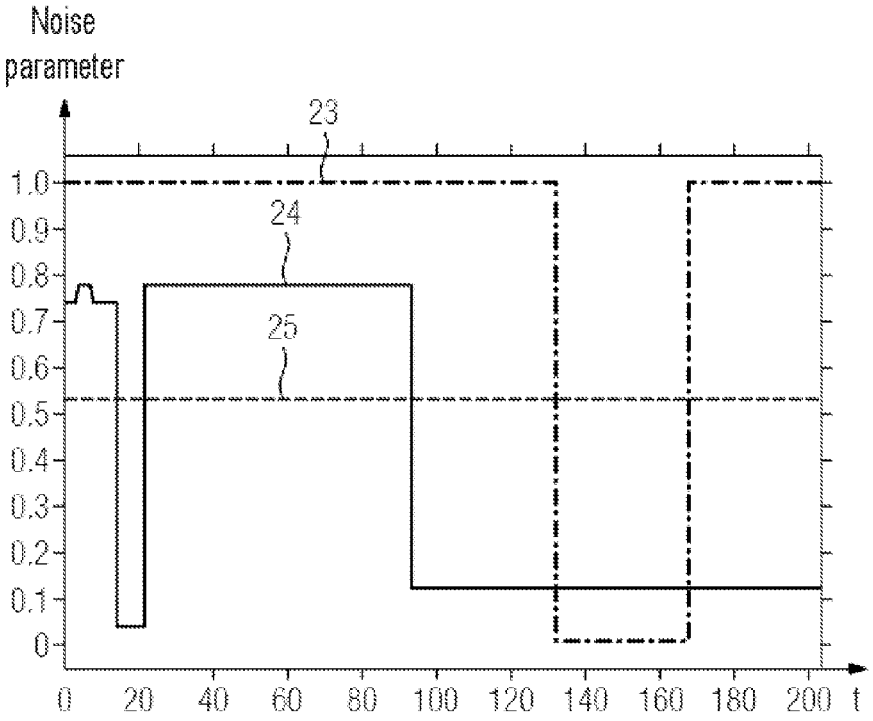
FIG. 6 is a graph showing the behavior over time of a plurality of classifiers.

FIG. 6 shows that the input adaptation improves the time stability of the output signal. In particular, what is depicted is the output signal of three different methods, by which a test audio file, which consists of a mixture of speech and noise, is classified. The curves represent the output of a noise parameter over the time t. The curve 23 shows the output signal of a classifier which can only output binary output signals (0, 1). The output signal exhibits undesirably large jumps. The curve 24 shows the output signal of a system with which it is also possible to produce intermediate values between 0 and 1. However, the output signal still exhibits clear jumps since the test input signals are assigned to different clusters with different parameter labels (e.g. 0.8, 0.12, 0.05). The curve 25 reproduces the output signal of the same system as that from curve 24, but with input adaptation. The output variation disappears completely since the test input signals are assigned to movable clusters which in this case have the same parameter labels. The input adaptation therefore leads to significantly improved aural perception. Therefore, FIG. 6 indicates how strongly the respectively current situation is a noise situation.

FIGS. 7 and 8 show a specific example for calculating the cluster labels by recursive updating. The circles in both figures represent clusters. The values in the circles represent cluster labels. The connecting lines between the clusters represent the respective cluster distances. In one iteration step n, the values in the graph, depicted in FIG. 7, emerge. Additionally, there is a user input with the label value "2" at the cluster position 26.

In the iteration step n+1, depicted in FIG. 8, the cluster labels are recalculated. The cluster closest to the cluster position 26 receives the label value "2". The labels for the iteration step n+1 are calculated according to the following formula: $yc(n+1)=(1-\lambda c)yc(n)+\lambda cyl$ for all clusters c. Here, y denotes the respective label value, n the discrete time step $\lambda c$, which can assume values between 0 and 1, represents the influence of the user input on the respective cluster label and can for example be a monotonic function of the respective distance on the graph.

The invention claimed is:

1. A method for automatically setting a piece of equipment, which comprises the steps of:

determining a feature vector from an input signal of the equipment;

providing a movable cluster from a subset of movable clusters and a fixed cluster from a subset of fixed clusters in a multidimensional space, wherein the fixed cluster being situated at a fixed first cluster position in the multidimensional space;

displacing the movable cluster in a direction of the feature vector to a second cluster position;

assigning respectively one setting variable to the movable cluster and the fixed cluster, by means of the one setting variable the equipment can be set; and setting the equipment, for which purpose an output variable is computed on a basis of the first cluster position, the second cluster position and setting variables.

2. The method according to claim 1, wherein the displacing of the movable cluster is performed depending on a trigger signal.

3. The method according to claim 2, wherein the trigger signal is a switch-on signal, a time signal or a user input signal.

4. The method according to claim 1, wherein there are a multiplicity of movable clusters and the feature vector is assigned to that one of the movable clusters to which it has a smallest spatial distance, and the movable cluster is affected by displacement.

5. The method according to claim 1, wherein at least one of the setting variables is at least in part modified by a user input.

6. The method according to claim 5, wherein each of the setting variables of the fixed cluster and/or the movable cluster can only be modified within a range specifically predefined in each case.

7. The method according to claim 1, wherein the setting variable of a displaced cluster is determined by a neighborhood-based regression or recursive updating.

8. The method according to claim 1, wherein the setting variable is selected from the group consisting of a parameter value, a parameter vector, a predefined class value and a gradual class value.

9. A classifier for an automatically settable piece of equipment, the classifier comprising:

a signal input apparatus for providing an electrical input signal;

a feature extraction apparatus for establishing a feature vector from an input signal;

a position assignment apparatus, in which a movable cluster from a subset of movable clusters and a fixed cluster from a subset of fixed clusters are provided in a multidimensional space, the fixed cluster being situated at a fixed first cluster position in the multidimensional space;

an adaptation apparatus for displacing the movable cluster in a direction of the feature vector to a second cluster position, wherein respectively one setting variable is assigned to the movable cluster and the fixed cluster, wherein by means of the one setting variable the automatically settable piece of equipment can be set; and an output apparatus for outputting an output variable for setting the automatically settable piece of equipment on a basis of the first cluster position, the second cluster position and setting variables.

10. A hearing device, comprising:

a classifier for an automatically settable piece of equipment, said classifier containing:

an signal input apparatus for providing an electrical input signal;

a feature extraction apparatus for establishing a feature vector from an audible input signal;

a position assignment apparatus, in which a movable cluster from a subset of movable clusters and a fixed cluster from a subset of fixed clusters are provided in a multidimensional space, the fixed cluster being situated at a fixed first cluster position in the multidimensional space;

an adaptation apparatus for displacing the movable cluster in a direction of the feature vector to a second cluster position, wherein respectively one setting variable is assigned to the movable cluster and the fixed cluster, wherein by means of the one setting variable the automatically settable piece of equipment can be set; and an output apparatus for outputting an output variable for setting the automatically settable piece of equipment on a basis of the first cluster position, the second cluster position and setting variables.

* * * * *